US006789284B2

(12) United States Patent
Kemp

(10) Patent No.: US 6,789,284 B2
(45) Date of Patent: Sep. 14, 2004

(54) INFLATABLE SUPPORT

(75) Inventor: Daniel Kemp, Enfield (GB)

(73) Assignee: Huntleigh Technology, PLC (GB)

( * ) Notice: Subject to any disclaimer, the term of this patent is extended or adjusted under 35 U.S.C. 154(b) by 0 days.

(21) Appl. No.: 10/311,202

(22) PCT Filed: Dec. 7, 2001

(86) PCT No.: PCT/GB01/05418

§ 371 (c)(1),
(2), (4) Date: Dec. 13, 2002

(87) PCT Pub. No.: WO02/45641

PCT Pub. Date: Jun. 13, 2002

(65) Prior Publication Data

US 2003/0145386 A1 Aug. 7, 2003

(30) Foreign Application Priority Data

Dec. 9, 2000 (GB) ..... 0030210

(51) Int. Cl.[7] ..... A47C 27/10
(52) U.S. Cl. ..... 5/713; 5/710
(58) Field of Search ..... 5/713, 710, 714, 5/706

(56) References Cited

U.S. PATENT DOCUMENTS

| | | | | |
|---|---|---|---|---|
| 1,772,310 | A | | 8/1930 | Hart |
| 3,674,019 | A | | 7/1972 | Grant |
| 3,678,520 | A | | 7/1972 | Evans |
| 3,882,425 | A | | 5/1975 | Briley |
| 4,042,988 | A | | 8/1977 | Holliday |
| 4,193,149 | A | | 3/1980 | Welch |
| 4,225,989 | A | | 10/1980 | Corbett et al. |
| 4,267,611 | A | | 5/1981 | Agulnick |
| 4,336,621 | A | | 6/1982 | Schwartz et al. |
| 4,391,009 | A | | 7/1983 | Schild et al. |
| 4,472,847 | A | | 9/1984 | Gammons et al. |
| 4,639,960 | A | | 2/1987 | Quillen et al. |
| 4,679,264 | A | | 7/1987 | Mollura |
| 4,685,163 | A | | 8/1987 | Quillen et al. |
| 4,803,744 | A | | 2/1989 | Peck et al. |
| 4,807,313 | A | | 2/1989 | Ryder et al. |
| 4,953,247 | A | | 9/1990 | Hasty |
| 5,020,176 | A | | 6/1991 | Dotson |
| 5,129,115 | A | | 7/1992 | Higgins et al. |
| 5,189,742 | A | * | 3/1993 | Schild ..... 5/713 |
| 5,243,723 | A | | 9/1993 | Cotner et al. |

(List continued on next page.)

FOREIGN PATENT DOCUMENTS

| | | |
|---|---|---|
| EP | 0 560 563 | 12/1996 |
| FR | 2 757 377 | 6/1998 |

(List continued on next page.)

*Primary Examiner*—Alexander Grosz
(74) *Attorney, Agent, or Firm*—Brown Raysman Millstein Felder & Steiner

(57) ABSTRACT

A support surface 10 includes a series of inflatable cells 30, 40 inflated alternately by a compressor 11. The cells 30, 40 are exhausted via an exhaust port 50 having a restrictor 60 of known diameter. A pressure transducer 70 measures the cell 30, 40 pressure. Some of the cells 30, 40 during their deflating/inflating cycle are exhausted through the exhaust port 50 and the cell pressure decay over a time is monitored. A microprocessor calculates the mathematical function related to the cell pressure decay with time, compares the value with compiled data and adjusts the output of the compressor accordingly. The sequence of exhausting via a port 50 is repeated at every inflation/deflation cycle and the pressure decay monitored and compared with the known data and the compressor output adjusted automatically to provide a new operating pressure. Therefore, any change in the person's position, e.g., supine, to side or sitting are accommodated by the cell pressure automatically being adjusted to prevent bottoming or high interface pressures.

10 Claims, 3 Drawing Sheets

U.S. PATENT DOCUMENTS

| | | | | | |
|---|---|---|---|---|---|
| 5,249,318 | A | | 10/1993 | Loadsman | |
| 5,394,577 | A | | 3/1995 | James et al. | |
| 5,421,044 | A | | 6/1995 | Steensen | |
| 5,564,142 | A | | 10/1996 | Liu | |
| 5,619,764 | A | | 4/1997 | Lopau | |
| 5,634,224 | A | | 6/1997 | Gates | |
| 5,680,036 | A | | 10/1997 | Faulk | |
| 5,701,622 | A | | 12/1997 | Biggie et al. | |
| 5,745,942 | A | | 5/1998 | Wilkerson | |
| 5,765,246 | A | | 6/1998 | Shoenhair | |
| 5,774,917 | A | | 7/1998 | Liu | |
| 5,806,572 | A | | 9/1998 | Voller | |
| 5,890,245 | A | | 4/1999 | Klearman et al. | |
| 6,009,580 | A | * | 1/2000 | Caminade et al. | 5/710 |
| 6,094,762 | A | * | 8/2000 | Viard | 5/713 |
| 6,134,732 | A | | 10/2000 | Chapman et al. | |
| 6,148,461 | A | | 11/2000 | Cook et al. | |
| 6,349,439 | B1 | | 2/2002 | Cook et al. | |

FOREIGN PATENT DOCUMENTS

| | | |
|---|---|---|
| GB | 159 299 | 2/1921 |
| GB | 959 103 | 5/1964 |
| GB | 2 090 734 | 7/1982 |
| GB | 2 167 293 | 5/1986 |
| GB | 2 197 192 | 5/1988 |
| GB | 2 267 217 | 12/1998 |
| WO | WO86/02244 | 4/1986 |
| WO | WO86/05973 | 10/1986 |
| WO | WO97/17869 | 5/1997 |
| WO | WO98/24345 | 6/1998 |
| WO | WO99/39613 | 8/1999 |
| WO | WO01/74287 | 10/2001 |

* cited by examiner

INFLATABLE SUPPORT

This application is a National Phase entry of PCT International Application, Serial No. PCT/GB01/05418, filed 7 Dec. 2001, and claims priority from Great Britain Application No. 0030210.9, filed 9 Dec. 2000.

BACKGROUND OF THE INVENTION

The invention relates to an inflatable support for the prevention and treatment of pressure sores.

Pressure sores are a condition of progressive tissue death caused primarily by the combination of pressure and shear forces on the human body particularly in the regions of the bony prominences such as ischials, trochanter and heels. These forces act by reducing or stopping the microcirculatory function bringing fresh nutrients (including oxygen) to and removing waste products from the soft tissues underlying the skin. Pressure sores are always debilitating, can often be fatal and even with optimum intervention take from weeks to months to completely heal. The resulting costs for a developed nation (including NATRA, EU, Australasia, Japan) range from £100 m to £600 m annually.

Pressure relieving or reducing supports are provided both in mattress form for lying on and seat product form supporting the buttocks and sometimes the back in operation. All of these support products use different technologies but can be put into two categories by the way they deal with the problem of lowering the pressures imposed on the vulnerable bony prominences (which are at highest risk of pressure sores) by supporting the weight of the human body.

These pressures must be reduced below those that compromise or stop altogether the functions of the capillary bed of the microcirculation in delivering nutrients and removing waste products. For a healthy person this is approximately 32 mmHg but at the capillary bed exits the pressure can be as low as 12–14 mmHg for some persons.

Pressure reducing products work by moulding themselves around the shape of that part of the human body in contact with them, creating the largest contact area and therefore lowering the contact pressures. The technologies used include foam, static air filled bags, gel filled bags, water mattresses and waterbeds. These may be used alone or in combination and include fluidising fine silica beads to create a liquid like substance supporting the body by Archimedes principle of upthrust and displacement balance used for burns patients.

However typical human skin area is 1.8 m2 and in a supine back lying position at most half of this could be contact area so this limits the ultimate pressure reduction.

The alternative concept is that of pressure relief where the part of the body in contact with the mattress or seating product is supported only partially with the contact points being removed in location over time by raising and lowering each part of the product in a predetermined sequence. This principle is invariably implemented using air to inflate or deflate bladders called cells within the product in the predetermined sequence required. Such products are commonly referred to as alternating air products. These static or alternating air based pressure sore mattress and seating products form the largest and most clinically effective (in alternating form) part of all such products.

The pressures imposed by an air mattress on the body are called interface pressures and are a function of the internal or operating pressure of the system. If internal pressure is too low than the parts of body supported touch the base below. But too high a pressure and pressure sores may develop. The majority of people associate lower pressures with more comfort. Patient perception of comfort is important to obtain high compliance and optimum sleep patterns for faster healing.

It is known that operating pressure has to be optimised for an individual patient and is dependent on spatial distribution of patient body density over the area in contact with the mattress or seating product and varies with each patient and their position on the mattress.

Because the bodies' average density varies considerably between trunk (low average density) and other parts such as heels (high average density) many air products are divided into separate sections or zones each with a different operating pressure.

In order to get optimum pressure reduction or relief, a number of such products, even multi-zoned, use manual operating pressure settings relying entirely on the user or carer for appropriate adjustment.

However, manual operating pressure control raises many problems, namely, it is labour intensive within the hospital, it is not practical in nursing homes and particularly homecare as there are no trained staff present and may be vulnerable to inadvertent mis-setting to ineffective or unsafe positions. Furthermore, apart from gap setting (see below) there is no guide to the right value to guarantee no bottoming and balance good clinical efficacy with acceptable comfort to the patient.

Gap setting adjustment involves setting operating pressure to get clearance of two or three fingers width or palm thickness between the lowest part of the patients body and the mattress or seat base. This is physically intrusive for the patient and difficult or impossible with most mattress designs due to obstructions of parts of the inflated structure.

Some alternating systems provide semi-automatic operating pressure setting by means of additional sensors either under the mattress or within the mattress to indicate when the patient is at risk of bottoming and to control the pump to re-inflate the mattress.

However, such systems do not accommodate different positions of the patient on the mattress, are complex and still require the user to set initial operating pressure upon first use. Static systems are known which upon setting of an operating pressure will then maintain the desirable operating pressure dependent on the user's weight by using look up tables and pressure sensors sensing and adjusting the internal pressure of the mattress. As with the alternating systems, such systems still require the initial pressure to be set by the caregiver or user.

SUMMARY OF THE INVENTION

The invention provides a simple system that, among other advantages, removes the need for manual control of the operating pressure of alternating air mattresses or static systems and automatically sets the correct operating pressure upon use by the user; and resets the operating pressure and maintains the same dependent on change of position of the user or mattress.

Accordingly, the invention provides an inflatable support for a user comprising one or more inflatable cells inflated with fluid from a source to a set pressure, means for venting at least one cell through a known restrictor and measuring the pressure change over time, control means converting this pressure change time value into a mathematical coefficient and comparing with known experimental data, and selecting or determining the optimum support pressure and adjusting the source output to provide the optimum support pressure.

An advantage of the invention is that it uses existing cell air and pressure sensors without adding any components into the mattress. There are no sensors in the mattress, thereby any inflatable mattress is suitable for use in practicing the invention.

Preferably, the cell(s) are vented once every cycle of inflation and deflation in an alternating system for continuous monitoring and resetting of the optimum support pressure.

In a preferred embodiment, the means for venting at least one of the cells is actuated during the deflation cycle. Alternatively, the venting means may be actuated during the inflation cycle.

Preferably, the cell air is vented through a series of restrictors, or more preferably a variable restrictor.

Preferably, the control means includes compiled experimental data of pressure decay with time and associated mathematical coefficients for a large number of users with different body anatomies, on different mattresses and cushions and with differing initial set pressures. More preferably, the control means adds new patient anatomy types and corresponding mathematical coefficient not present in the known experimental data.

Preferably, the inflatable support may have an additional anti-bottoming sensor to allow for lower overall operating pressures, for greater user comfort.

The anti-bottoming sensor may comprise a sensor mat as described in commonly-owned European Patent No. 560563, the entire content of which is hereby incorporated by reference.

In a preferred embodiment the inflatable support may be controlled by remote means connected to the control means.

DETAILED DESCRIPTION OF THE PREFERRED EMBODIMENTS

Preferred embodiments of methods, systems, and apparatus according to the invention are described through reference to the Figures.

Figure 1:
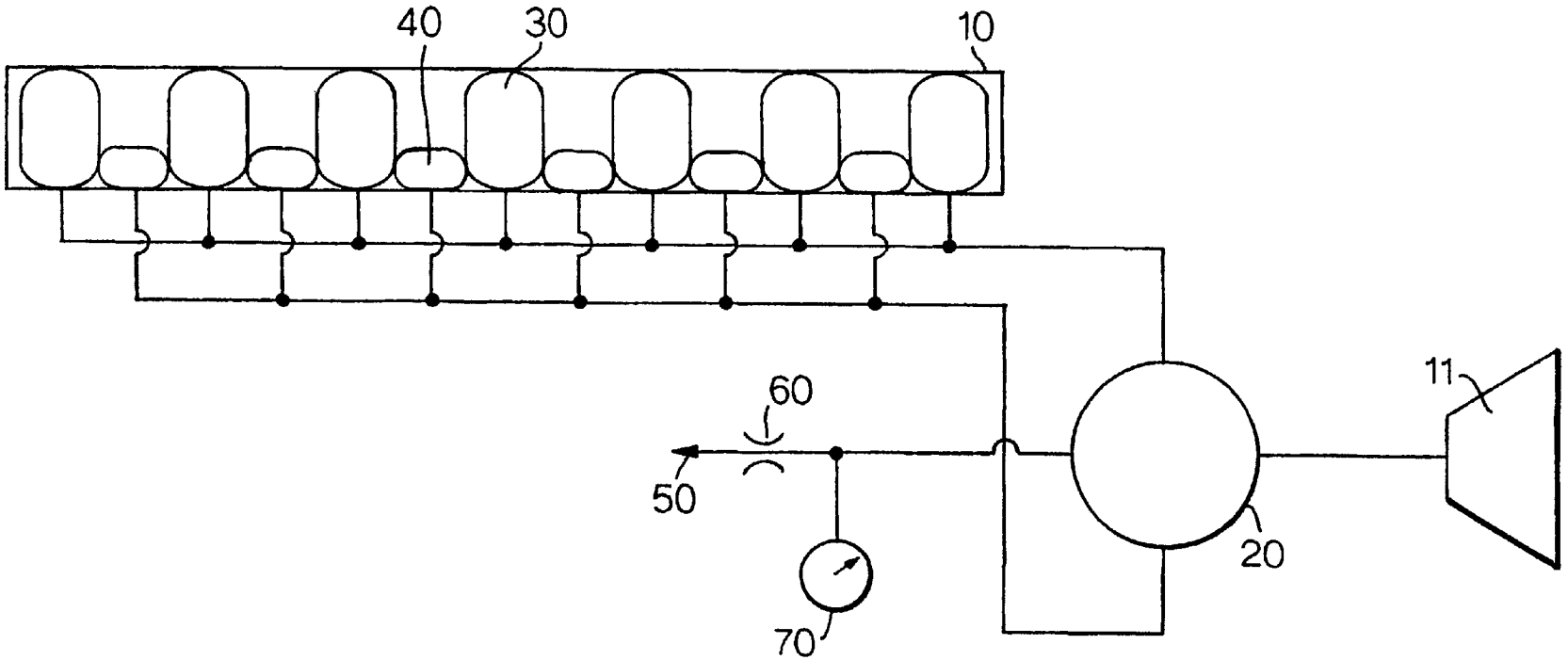
FIG. 1 is a schematic view of a preferred embodiment of a support surface in accordance with the present invention.

Referring now to FIG. 1, a support surface 10 includes a series of inflatable cells 30, 40 inflated alternately by a compressor 11 by means of either a rotor stator or a solenoid arrangement 20. The cells 30, 40 may be exhausted via exhaust port 50, the exhaust port incorporates a restrictor 60 of known diameter. A gauge pressure transducer 70 measures the cell 30, 40 pressure.

In use, the support surface is inflated to a set pressure, say 35 mmHg. The cells 30, 40 are respectively alternatively inflated and deflated by means of a rotor stator or solenoid 20 in a cycle typically lasting 10 minutes. At least some of the cells 30, 40 during their deflating cycle are then exhausted through the exhaust port 50 and the cell pressure decay over a time of say 90 seconds is monitored prior to full deflation of the cells. Thus the impact of loss of pressure in the cells 30, 40 in terms of user comfort is minimal.

In preferred embodiments a microprocessor calculates the mathematical function related to the cell pressure decay with time, and compares the value with the compiled experimental mathematical function data and adjusts the output of the compressor accordingly. These values have been collated by experiment by measuring cell pressure decay over time from set operating pressures for different anatomies of users and mattresses. The sequence of exhausting via port 50 may be repeated at every inflation/deflation cycle and the pressure decay monitored and compared with the known data. Any changes in coefficient values are automatically translated as adjustments in compressor output to provide a new operating pressure. In this way, any change in the person's position, e.g., lying on their back to their side or sitting is accommodated by the cell pressure automatically being adjusted to prevent bottoming or high interface pressures. We have found that the principle works equally if the cell pressure-time relationship is monitored during the inflation cycle of the cells 30, 40 instead of deflation, as described above.

Figure 2:
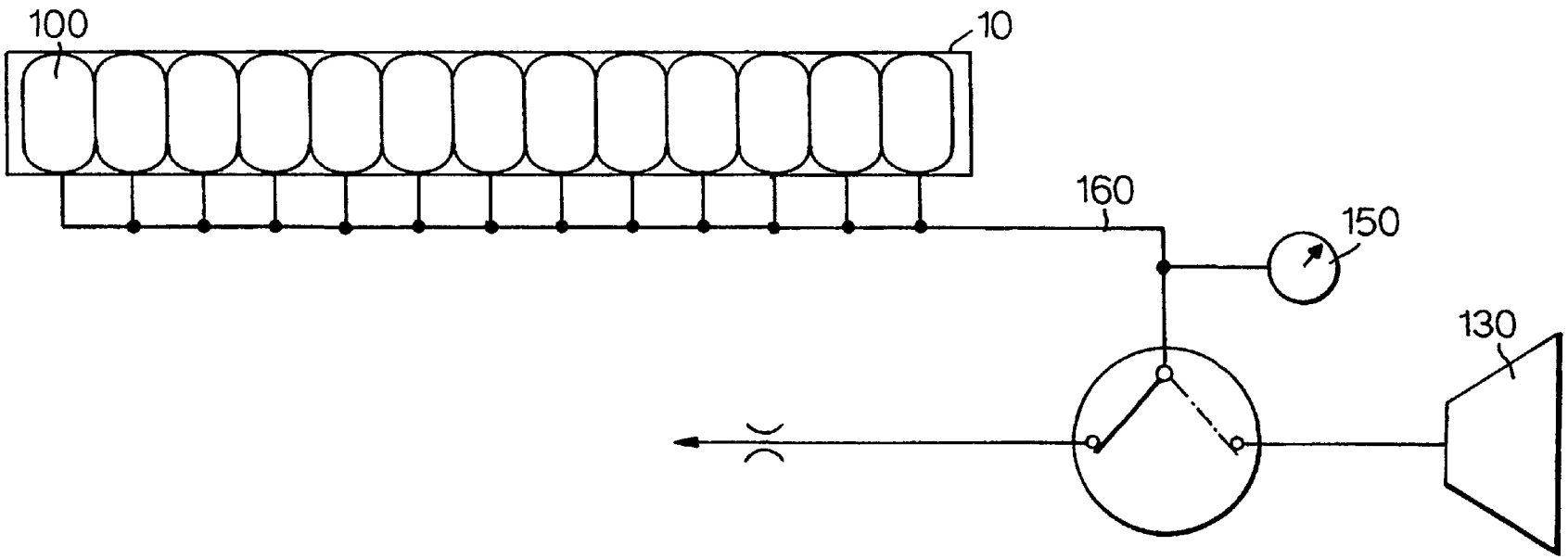
FIG. 2 is a schematic view of a support surface according to another preferred embodiment of the invention.

FIG. 2 shows a support surface 10 consisting of inflatable cells 100 which are inflated constantly by means of a compressor 130 of known output. A gauge pressure transducer 150 measures the cell pressure in the fluid lines 160 leading to the cells 100. Similar to the embodiment as described above, the cells are inflated to a set pressure of say 30 mmHG and then the cell pressure decay over time through a known restrictor is monitored. The value is translated to a mathematical coefficient which is compared to similar data compiled within the microprocessor for such a mattress with different anatomy of users and operating pressures and the compressor output adjusted to provide an operating pressure correlating to the coefficient value. This coefficient correlation of the cell pressure change-time relationship for a given individual user anatomy and operating pressure has been found to be to be consistent in providing optimum support pressure over a wide range to cover all human anatomical variation.

It is understood that the change in cell pressure monitored via the transducer in the above embodiments has a direct correlation to change in flow rates. Therefore monitoring the pressure change to adjust compressor output may be replaced by monitoring flow rate change that may also be compared to the relevant experimental data.

The invention provides a support surface automatically providing optimum support pressure taking into account user's anatomy without any input from the user.

This optimum pressure may be made more optimum to provide greater comfort to the user by having an additional anti-bottoming sensor located under the support. A typical anti-bottoming sensor as described in commonly-owned European Patent No. 560563 comprises a mat which ensures that the support is inflated sufficiently to prevent bottoming of the user i.e. touching the base under the support.

The user may also be able to control the support comfort by means of a remote control for adjusting the support pressure, but which would not compromise the therapy set by the caregiver.

Figure 3:
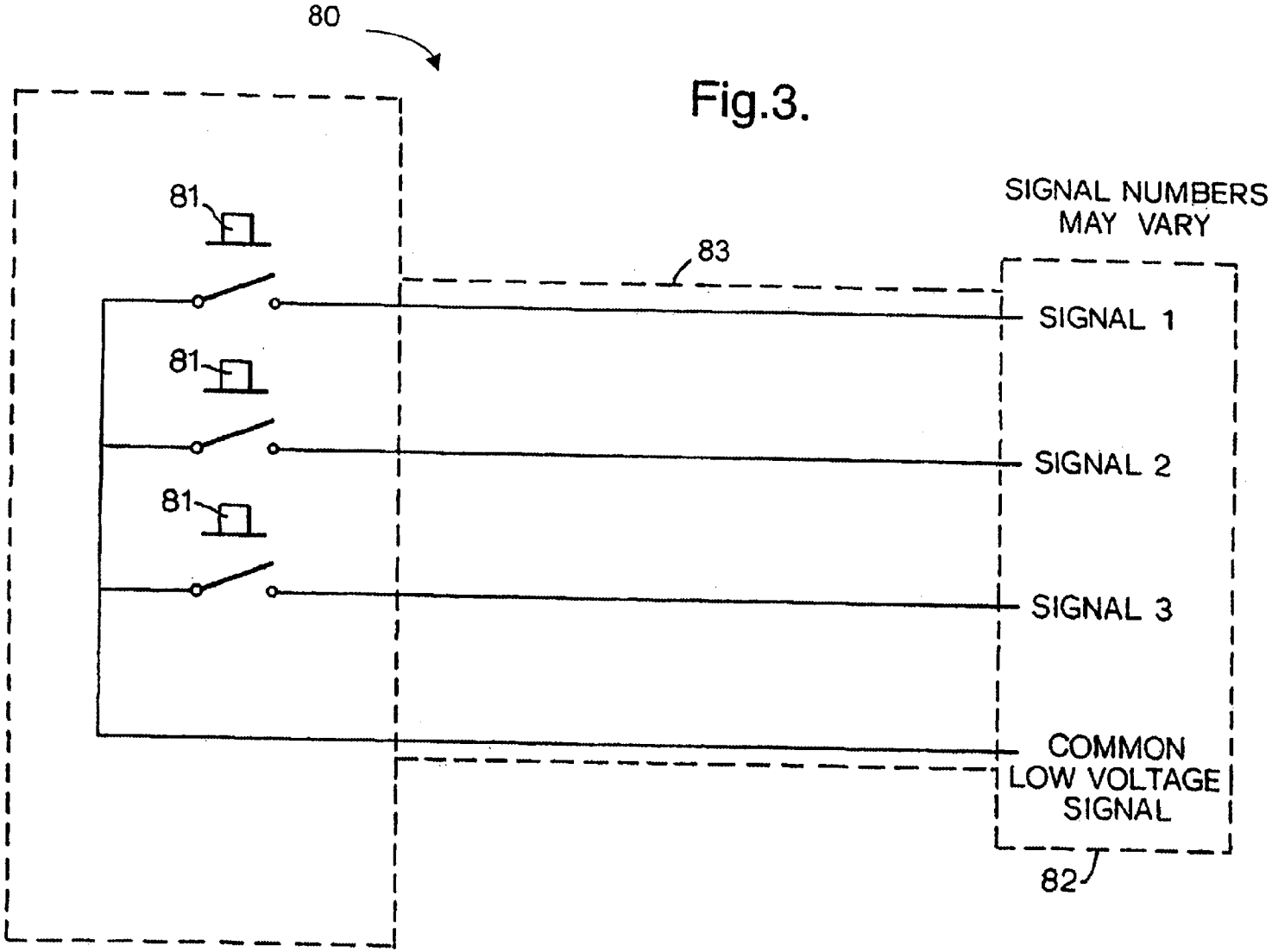
FIG. 3 is a circuit diagram of a remote control device suitable for operating a support according to the invention.

As shown in FIG. 3, the remote control 80 comprises a series of switches 81 that can be low voltage, and can be connected in parallel to the membrane control panel and duplicating their operation.

The switches 81 are connected by a wire or set of wires 83 to the pump via a connector 82. The connector 82 could comprise, for example, a telephone jack or similar device.

When a switch 81 is closed a digital signal is seen at the connector 82 from state 0 (e.g. 0V) to state 1 (e.g. 5V). This signal can be input into the microcontroller or control system in the pump interpreted and the corresponding action taken.

The remote control 80 is low cost, self powered and physically connected to the pump.

The connection system 82 further allows connection to a bed frame as the remote control 80 could have switches 81 to adjust bed position as well as the support comfort control.

What is claimed is:

1. An inflatable support comprising:

at least one inflatable cell inflated with fluid from a source to a set pressure;

means for venting the at least one cell through at least one restrictor; means for measuring a pressure change in the at least one cell over time; and control means for comparing the measured pressure change with known data, determining an optimum support pressure, and controlling the fluid source output to inflate the at least one cell to the optimum support pressure.

2. The inflatable support of claim 1, wherein the at least one cell is inflated and at least partially deflated in cycles for continual monitoring and resetting of the optimum support pressure.

3. The inflatable support of claim 1, wherein the means for venting the at least one cell is actuated during deflation of the cell.

4. The inflatable support of claim 1, wherein the means for venting the at least one cell is actuated during inflation of the cell.

5. The inflatable support of claim 1, wherein the at least one restrictor comprises a series of restrictors.

6. The inflatable support of claim 1, wherein the at least one restrictor comprises a variable restrictor.

7. The inflatable support of claim 1, wherein the control means includes compiled experimental data of pressure decay over time for a plurality of users with different body anatomies, on different supports and with differing initial set pressures.

8. The inflatable support of claim 7, wherein the control means adds new data of pressure decay over time associated with user anatomies and initial set pressures not present in the experimental data.

9. The inflatable support of claim 1, comprising an anti-bottom sensor.

10. The inflatable support of claim 1, wherein the inflatable support is controlled by remote means connected to the control means.

* * * * *